US008047680B2

(12) United States Patent
Huang et al.

(10) Patent No.: US 8,047,680 B2
(45) Date of Patent: Nov. 1, 2011

(54) LED LAMP WITH LARGE LIGHT EMITTING ANGLE

(75) Inventors: Xing-Gui Huang, Shenzhen (CN); Hai-Wei Zhang, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 222 days.

(21) Appl. No.: 12/581,167

(22) Filed: Oct. 19, 2009

(65) Prior Publication Data

US 2011/0002119 A1 Jan. 6, 2011

(30) Foreign Application Priority Data

Jul. 1, 2009 (CN) ..... 2009 1 0303907

(51) Int. Cl.
*F21V 21/00* (2006.01)

(52) U.S. Cl. ..... 362/249.02; 362/294; 362/218; 362/373

(58) Field of Classification Search ..... 362/217.01, 362/219, 222, 223, 224, 225, 217.02–217.07, 362/217.1, 217.11–217.17, 227, 235, 237, 362/238, 240, 244, 245, 246, 249.01, 249.02, 362/249.11, 294, 296.07, 310, 311.09, 326, 362/327, 405, 800; 313/499, 500, 501, 512
See application file for complete search history.

(56) References Cited

U.S. PATENT DOCUMENTS

| | | | | |
|---|---|---|---|---|
| 6,250,774 | B1 * | 6/2001 | Begemann et al. | 362/231 |
| 7,329,030 | B1 * | 2/2008 | Wang | 362/373 |
| 7,682,055 | B2 * | 3/2010 | Shuai et al. | 362/373 |
| 7,726,845 | B2 * | 6/2010 | Zheng et al. | 362/294 |
| 7,726,851 | B2 * | 6/2010 | Shuai et al. | 362/373 |
| 7,854,534 | B2 * | 12/2010 | Liu | 362/294 |
| 2009/0185374 | A1 * | 7/2009 | Wu et al. | 362/249.06 |

FOREIGN PATENT DOCUMENTS

WO WO 2008123711 A1 * 10/2008

* cited by examiner

*Primary Examiner* — Hargobind Sawhney
(74) *Attorney, Agent, or Firm* — Altis Law Group, Inc.

(57) ABSTRACT

An LED lamp includes a heat sink and a plurality of LED modules. The heat sink includes a base and a plurality of supporters extending from a top face of the base. Each supporter has an inclined supporting face facing an adjacent one of two opposite lateral sides of the base. Each LED module is mounted on an inclined supporting face of a corresponding supporter. The supporters have extending heights gradually increasing along a horizontal direction from the two opposite lateral sides toward a center of the base. Angles between the base and the supporting faces of the supporters are acute angles and gradually decrease along the horizontal direction from the two opposite lateral sides toward the center of the base.

18 Claims, 4 Drawing Sheets

LED LAMP WITH LARGE LIGHT EMITTING ANGLE

BACKGROUND

1. Technical Field

The disclosure relates to illumination devices and, particularly, to an LED (light emitting diode) lamp with a large light emitting angle.

2. Description of Related Art

LED illumination lamps have been quickly developed in recent years. Compared with traditional illumination devices, the advantages of the LED illumination lamps are small volume, short response time, long life, low driving voltage and better anti-shock capability.

A conventional LED lamp comprises a heat sink and a plurality of LED modules having LEDs attached to an outer surface of a heat sink. The heat sink dissipates heat generated by the LEDs. The outer surface of the heat sink generally is a plane and the LEDs are arranged close to each other. When the LED lamp works, the LEDs mounted on the planar outer surface of the heat sink only form a plane light source. A light emitting angle of the traditional LED lamp is very small. When applied in carbarn, mine or the like sites which need a three-dimensional illumination effect, the traditional LED lamp having small light emitting angle can not meet this big scale illumination demand.

What is needed, therefore, is an LED lamp with a large light emitting angle which can overcome the described limitations.

BRIEF DESCRIPTION OF THE DRAWINGS

Many aspects of the present apparatus can be better understood with reference to the following drawings. The components in the drawings are not necessarily drawn to scale, the emphasis instead being placed upon clearly illustrating the principles of the present apparatus. Moreover, in the drawings, like reference numerals designate corresponding parts throughout the several views.

DETAILED DESCRIPTION

Figure 1:
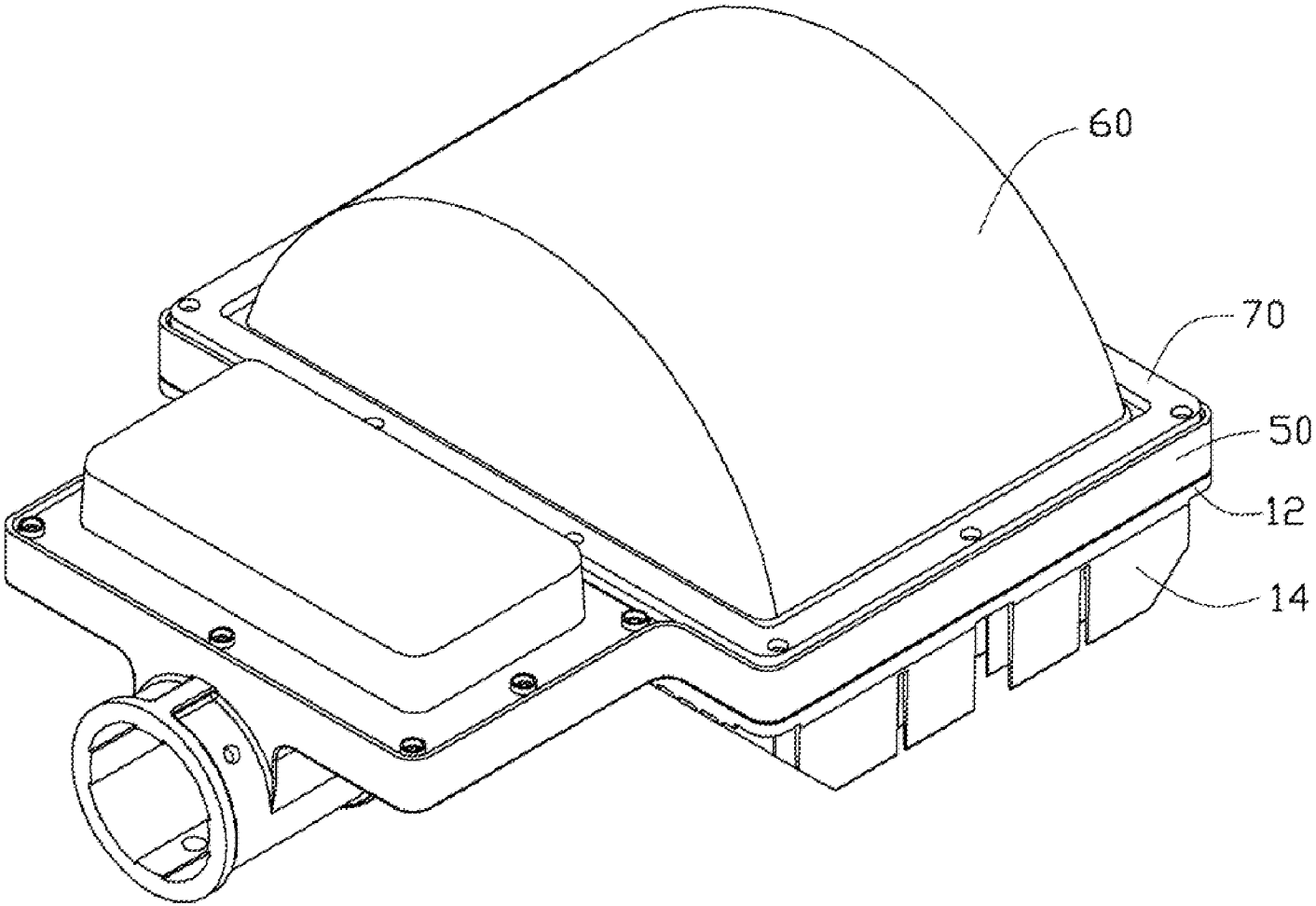
FIG. 1 is an isometric, assembled view of an LED lamp in accordance with an embodiment of the disclosure.
Figure 2:
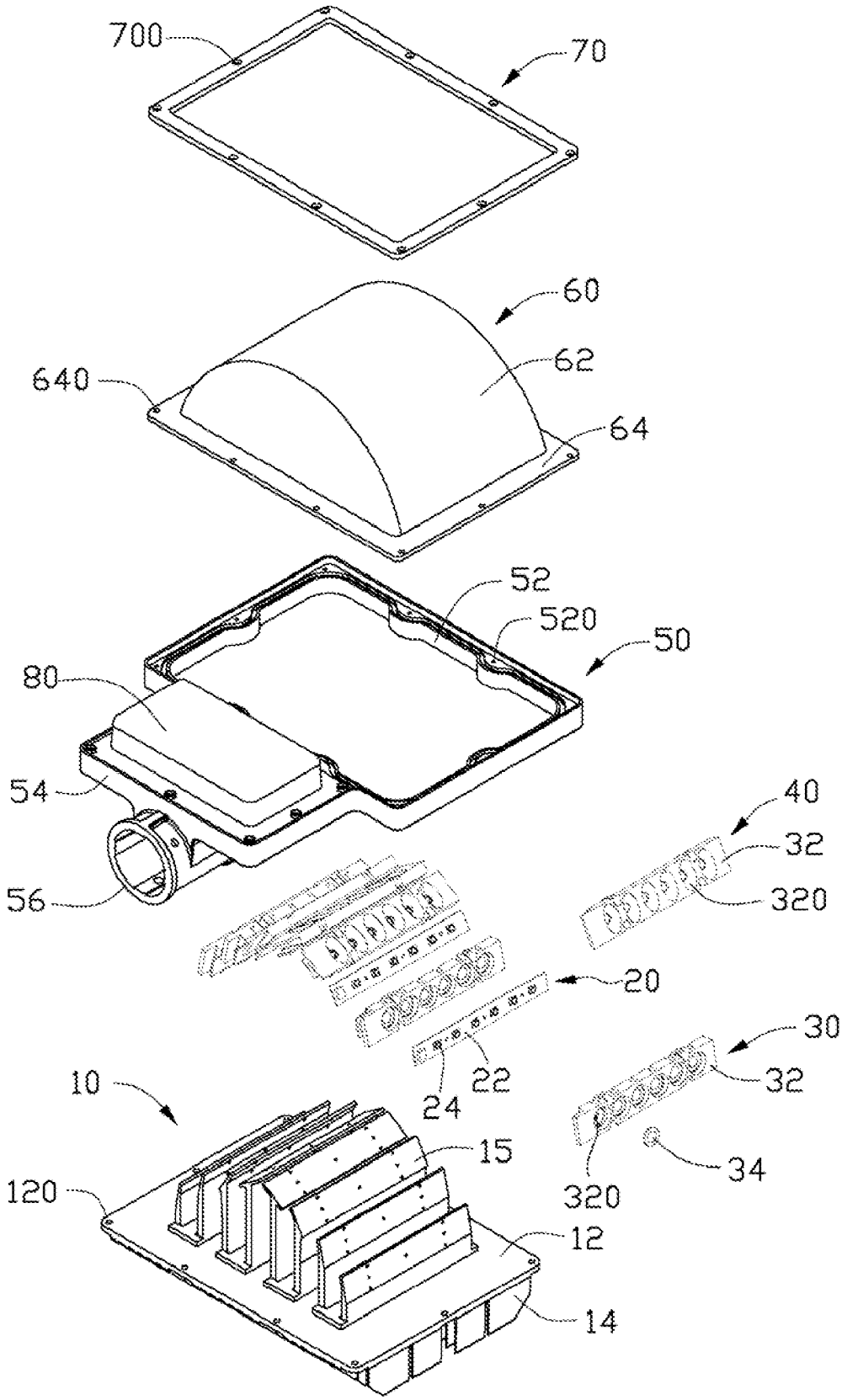
FIG. 2 is an isometric, exploded view of the LED lamp of FIG. 1.

Referring to FIGS. 1-2, an LED lamp in accordance with an embodiment of the disclosure includes a heat sink 10, a plurality of LED modules 20, a plurality of first light guiding modules 30, a plurality of second light guiding modules 40, a frame 50, a transparent envelope 60 and a cover plate 70.

Figure 3:
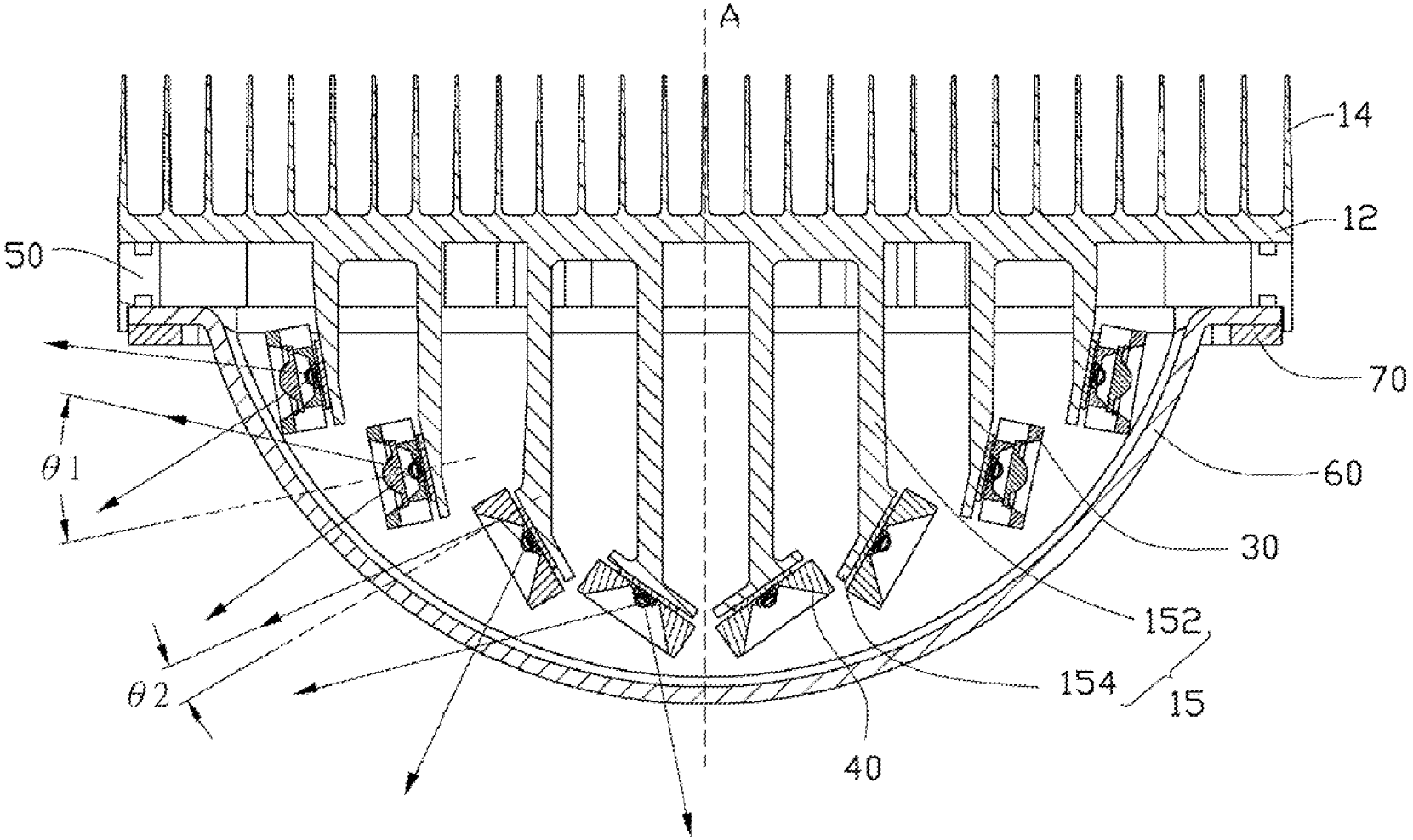
FIG. 3 is an inverted, cross-sectional view of the LED lamp of FIG. 1.

Also referring to FIG. 3, the heat sink 10 is made of metal such as aluminum, copper or an alloy thereof. The heat sink 10 includes a substantially rectangular plate-shaped base 12, a plurality of fins 14 vertically and downwardly extending from a bottom face of the base 12 and a plurality of supporters 15 vertically and upwardly extending from a top face of the base 12. A plurality of fixing holes 120 are defined in peripheral edges of the base 12. The supporters 15 can be divided into two groups which are located at two sides of an imaginary central line A of the base 12 of the heat sink 10 and symmetrical about the imaginary central line A, as viewed in FIG. 3. The imaginary central line A is between two lateral short sides of the base 12. The number of each group of the supporters 15 is four. The supporters 15 in each group have extending heights gradually increasing along a horizontal direction from a corresponding lateral short side of the base 12 toward the imaginary central line A of the base 12. Each supporter 15 includes a rectangular extending plate 152 extending from the top face of the base 12 and parallel to the imaginary central line A and a rectangular supporting plate 154 slantwise extending from a distal end of the extending plate 152. Each supporting plate 154 has an inclined supporting face 1540 facing outwardly toward the corresponding lateral short side of the base 12. Each supporting face 1540 has a corresponding LED module 20 mounted thereon.

Figure 4:
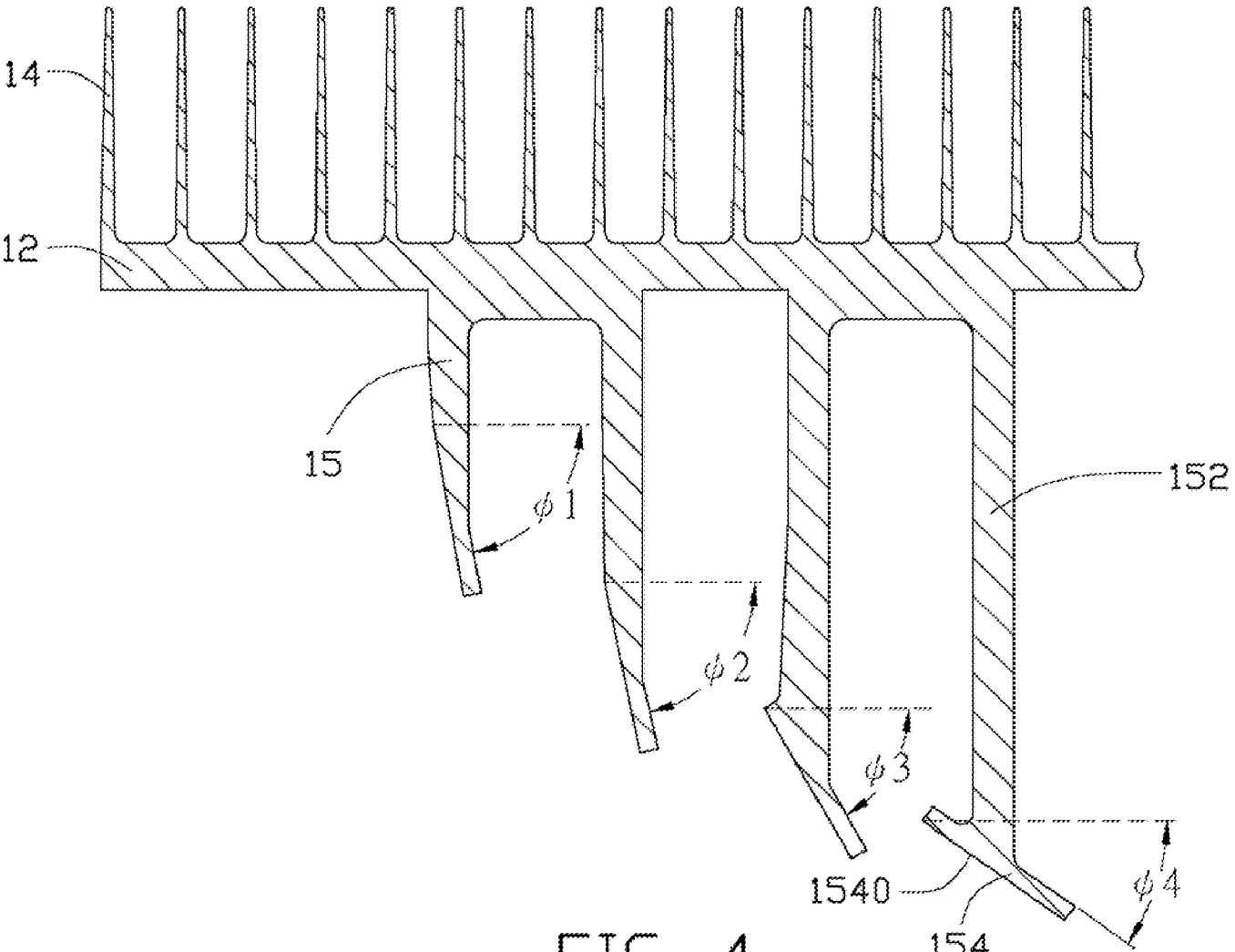
FIG. 4 is a partially enlarged view of a heat sink of the LED lamp of FIG. 3.

Also referring to FIG. 4, when the heat sink 10 is placed horizontally, the base 12 is parallel to a horizontal plane; an intersecting angle between the base 12 and the supporting plate 154 of the supporter 15 can be considered as an inclined angle ψ of the supporting plate 154 relative to the horizontal plane. The inclined angle ψ of the supporting plate 154 relative to the horizontal plane is an acute angle. The inclined angles of the supporting plates 154 relative to the horizontal plane are defined as angles ψ1~ψ4, respectively, along a direction from the lateral short side of the base 12 toward the imaginary central line A (shown in FIG. 4). The values of the angles ψ1~ψ4 of the two groups of the supporters 15 decrease along the horizontal direction from the two opposite lateral short sides toward the imaginary central line A of the base 12.

Each of the LED modules 20 includes an elongated printed circuit board 22 and a plurality of LEDs 24 mounted on the printed circuit board 22. The printed circuit board 22 is mounted on the supporting face 1540 of the supporting plate 154, and the LEDs 24 are arranged in a line along a lengthwise direction of the corresponding supporting plate 154.

Each of the first light guiding modules 30 and the second light guiding modules 40 includes an elongated fixing bracket 32 placed on a corresponding printed circuit board 22. The difference between the first light guiding module 30 and the second light guiding module 40 is that the first light guiding module 30 further includes a plurality of lenses 34. The four LED modules 20 near the imaginary central line A of the base 12 are covered by the second light guiding modules 40, and the four LED modules 20 near the two opposite lateral short sides of the base 12 are covered by the first light guiding modules 30. The fixing bracket 32 of the first light guiding module 30 defines a plurality of circular through holes 320 enclosing the LEDs 24 on the printed circuit board 22. The fixing bracket 32 of the second light guiding module 40 defines a plurality of elliptic through holes 320 enclosing the LEDs 24 on the printed circuit board 22. A lengthwise direction of each elliptic through hole 320 is perpendicular to that of the printed circuit board 22. Light reflecting material is coated on an inner face of the fixing bracket 32 defining each through hole 320 for reflecting light from the LED 24 out of the fixing bracket 32. The lenses 34 are disposed in the through holes 320 of the fixing bracket 32 of the first light guiding module 30 and are located over the LEDs 24 on the printed circuit board 22.

Each of the LED modules 20 is covered by one of the first light guiding modules 30 and the second light guiding modules 40, whereby a light emitting angle of the LED 24 is adjusted by a corresponding light guiding module 30 (40) to a suitable range; therefore, this light emitting angle can be interpreted as a light emitting angle of a combination of the LED 24 and the corresponding light guiding module covering thereon, hereinafter, represented by θ; in detail, θ1 represents a light emitting angle of light from the LED 24 extending through a corresponding first light guiding module 30, and θ2 represents a light emitting angle of a combination of the LED 24 and a corresponding second light guiding module 40 covering thereon. It can be easily inferred that ψ+θ represents an inclined angle of the light reflected out of the light guiding module 30 (40) relative to the imaginary central line A of the base 12. The relation between ψ1, ψ2 and θ1 meets following inequalities:

$$75° < \psi 1 + \theta 1 < 90°;$$

$$65° < \psi 2 + \theta 1 < 80°;$$

and the relation between ψ3, ψ4 and θ2 meets following inequalities:

$$30° < \psi 3 + \theta 2 < 70°;$$

$$10° < \psi 4 + \theta 2 < 40°.$$

According to the above inequalities, it can be inferred that the two LED modules 20 incorporating corresponding first light guiding modules 30 covering thereon nearest the two opposite lateral short sides of the base 12 have the largest light emitting range which doubles the inclined angle ψ1+θ1 and varies from 150° to 180°, and the two LED modules 20 incorporating corresponding second light guiding modules 40 covering thereon nearest the imaginary central line A of the base 12 have the smallest light emitting range which doubles the inclined angle ψ4+θ2 and varies from 20° to 80°, so that the LED lamp can illuminate different areas according to practical illumination requirements.

The frame 50 includes a rectangular first frame portion 52 and a rectangular second frame portion 54 horizontally extending from the first frame portion 52. The first frame portion 52 has a rectangular, loop-shaped structure with four sides and encloses the extending plates 152 of the supporters 15 of the heat sink 10. A bottom of the first frame portion 52 engages with the base 12 of the heat sink 10. The first frame portion 52 defines a plurality of through holes 520 in the four sides thereof, corresponding to the fixing holes 120 of the base 12. A hollow sleeve 56 horizontally extends from a bottom of the second frame portion 54 for connecting with a lamp post (not shown) to fix the LED lamp at a required position. A power converter 80 is fastened on a top of the second frame portion 54.

The envelope 60 includes a main part 62 having an arc-shaped cross section and a periphery part 64 extending horizontally and outwardly from peripheral edges of the main part 62. The periphery part 64 engages with a top of the first frame portion 52 of the frame 50 and defines a plurality of through holes 640 corresponding to the through holes 520 of the frame 50. The envelope 60 covers the LED modules 20, the first light guiding modules 30 and the second light guiding modules 40 therein. The envelope 60 can be made of glass, polycarbonate, polymethyl, methacrylate or other suitable material. The envelope 60 can be treated to be frosted structure or transparent structure to achieve various visual effects.

The cover plate 70 is integrally formed from a flat metal sheet. The cover plate 70 has a rectangular, loop-shaped structure with four sides corresponding to the structure of the periphery part 64 of the envelope 60. Each side of the cover plate 70 engages a corresponding side of the periphery part 64 of the envelope 60. The cover plate 70 defines a plurality of through holes 700 corresponding to the through holes 640 of the periphery part 64. A plurality of screws (not shown) extend through the through holes 700 of the cover plate 70, the through holes 640 of the envelope 60 and the through holes 520 of the frame 50 in sequence and engage in the fixing holes 120 of the base 12 to assemble the cover plate 70, the envelope 60, the frame 50 and the heat sink 10 together.

It is to be understood, however, that even though numerous characteristics and advantages of the present embodiments have been set forth in the foregoing description, together with details of the apparatus and function of the embodiments, the disclosure is illustrative only, and changes may be made in detail, especially in matters of shape, size, and arrangement of parts within the principles of the embodiments to the full extent indicated by the broad general meaning of the terms in which the appended claims are expressed.

The invention claimed is:

1. An LED lamp comprising:

a heat sink comprising a base and a plurality of supporters extending from a top face of the base, each supporter having an inclined supporting face facing an adjacent one of two opposite lateral sides of the base; and a plurality of LED modules each mounted on the inclined supporting face of a corresponding supporter;

wherein the supporters have extending heights gradually increasing along a horizontal direction from the two opposite lateral sides toward a center of the base, and angles between the base and the supporting faces of the supporters are acute angles and gradually decrease along the horizontal direction from the two opposite lateral sides toward the center of the base.

2. The LED lamp as claimed in claim 1, wherein each of the supporters comprises an extending plate extending from the top face of the base and a supporting plate slantwise extending from a distal end of the extending plate, the supporting face being defined on a top of the supporting plate.

3. The LED lamp as claimed in claim 1, wherein the supporters are located at two sides of the center of the base and symmetrical about the center of the base.

4. The LED lamp as claimed in claim 1, wherein each of the LED modules comprises a printed circuit board mounted on the supporting face of the corresponding supporter and a plurality of LEDs mounted on the printed circuit board.

5. The LED lamp as claimed in claim 4, wherein the LEDs of the LED module are arranged in a line along a lengthwise direction of the supporting face of the corresponding supporter.

6. The LED lamp as claimed in claim 4 further comprising a plurality of first light guiding modules covering some of the LED modules near the two opposite lateral sides of the base, each of the first light guiding modules comprising a fixing bracket placed on a corresponding printed circuit board and a lens located over one of the LEDs on the corresponding printed circuit board.

7. The LED lamp as claimed in claim 6, wherein the fixing bracket of each of the first light guiding modules defines a plurality of circular through holes enclosing the LEDs on the corresponding printed circuit board, light reflecting material being coated on an inner face of the fixing bracket defining each of the through holes, the lenses being disposed in the through holes of the fixing bracket of each of the first light guiding modules.

8. The LED lamp as claimed in claim 6, wherein two of the LED modules incorporating corresponding first light guiding modules covering thereon and located nearest the two opposite lateral sides of the base have the largest light emitting range which varies from 150° to 180°.

9. The LED lamp as claimed in claim 4 further comprising a plurality of second light guiding modules covering some of the LED modules near the center of the base, each of the second light guiding modules comprising a fixing bracket placed on a corresponding printed circuit board.

10. The LED lamp as claimed in claim 9, wherein the second light guiding modules are located two sides of the center of the base and symmetrical about the center of the base.

11. The LED lamp as claimed in claim 9, wherein each of the fixing bracket of the second light guiding modules defines a plurality of elliptic through holes enclosing the LEDs on the corresponding printed circuit board, light reflecting material being coated on an inner face of each of the fixing brackets defining each of the through holes, lengthwise direction of each elliptic through hole being perpendicular to that of the printed circuit board.

12. The LED lamp as claimed in claim 1, wherein the heat sink further comprises a plurality of fins extending from a bottom face of the base.

13. The LED lamp as claimed in claim 1 further comprising a frame comprising a first frame portion and a second frame portion extending from the first frame portion, the first frame portion having a bottom thereof engaging with the base of the heat sink, a hollow sleeve extending from the second frame portion adapted for connecting with a lamp post.

14. The LED lamp as claimed in claim 13 further comprising an envelope comprising a main part having an arc-shaped cross section and a periphery part extending from the main part, the periphery part engaging with a top of the first frame portion of the frame, the envelope covering the LED modules therein.

15. An LED lamp comprising:

a heat sink comprising a base and a plurality of supporters extending from a top face of the base, each supporter having an inclined supporting face facing an adjacent one of two opposite lateral sides of the base;

a frame comprising a first frame portion and a second frame portion extending from the first frame portion, the first frame portion having a bottom thereof engaging with the base of the heat sink, a hollow sleeve extending from the second frame portion for connecting with a lamp post; and a plurality of LED modules each comprise a printed circuit board mounted on the supporting face of a corresponding supporter and a plurality of LEDs mounted on the printed circuit board;

wherein the supporters have extending heights gradually increasing along a horizontal direction from the two opposite lateral sides toward a center of the base, and angles between the base and the supporting faces of the supporters are acute angles and gradually decrease along the horizontal direction from the two opposite lateral sides toward the center of the base.

16. The LED lamp as claimed in claim 15, wherein the first frame portion has a rectangular, loop-shaped structure with four sides enclosing the supporters of the heat sink.

17. The LED lamp as claimed in claim 15 further comprising a plurality of first light guiding modules covering some of the LED modules near the two opposite lateral sides of the base, each of the first light guiding modules comprising a fixing bracket placed on a corresponding printed circuit board and a lens located over the LEDs on the corresponding printed circuit board.

18. The LED lamp as claimed in claim 17 further comprising a plurality of second light guiding modules covering some of the LED modules near the center of the base, each of the second light guiding modules comprising a fixing bracket placed on a printed circuit board.

* * * * *